US006526585B1

(12) United States Patent
Hill

(10) Patent No.: US 6,526,585 B1
(45) Date of Patent: Mar. 4, 2003

(54) WET SMOKE MASK

(76) Inventor: Elton E. Hill, 351 Seymour Ave., Newark, NJ (US) 07112

( * ) Notice: Subject to any disclaimer, the term of this patent is extended or adjusted under 35 U.S.C. 154(b) by 0 days.

(21) Appl. No.: 10/028,102

(22) Filed: Dec. 21, 2001

(51) Int. Cl.[7] ..... A42B 1/18

(52) U.S. Cl. ..... 2/7; 2/206; 128/206.14; 128/206.19

(58) Field of Search ..... 2/202, 171.2, 173, 2/410, 7, 8, 424, 9, 171, 171.3, 206, 906, 918; 128/206.12, 206.16, 206.21, 206.28, 206.19, 206.23, 206.24, 207.11, 206.14

(56) References Cited

U.S. PATENT DOCUMENTS

| | | | | | |
|---|---|---|---|---|---|
| 3,768,100 | A | * | 10/1973 | Colman et al. | 2/206 |
| 3,878,563 | A | * | 4/1975 | Pulju | 2/9 |
| 4,095,290 | A | * | 6/1978 | O'Brien | 2/174 |
| 4,582,054 | A | | 4/1986 | Ferrer | |
| 4,641,379 | A | * | 2/1987 | Martin | 128/206.28 |
| D338,282 | S | | 8/1993 | Antol | |
| 5,322,060 | A | | 6/1994 | Johnson | |
| 5,392,465 | A | | 2/1995 | Shou | |
| 5,452,712 | A | | 9/1995 | Richardson | |
| 5,694,928 | A | * | 12/1997 | Hoftman | 128/206.19 |
| 5,875,775 | A | | 3/1999 | Nur et al. | |
| 6,308,330 | B1 | * | 10/2001 | Hollander et al. | 128/206.14 |

* cited by examiner

*Primary Examiner*—Gary L Welch

(57) ABSTRACT

A wet smoke mask for preventing the inhalation of smoke includes a first mask including a plate. The plate has size and shape for covering the face of user. The plate has an opening therein. The opening is positionable over the nose and mouth of a user. The plate has a pair of eye windows therein for seeing through the plate. A plurality of straps is attached to the first mask for removably securing the first plate to the head of a user of the device. A second mask includes an air permeable panel. The panel has a size adapted for covering the opening. A band is attached to opposite edges of the panel. The band comprises an elastic material. The second mask is positioned around the first mask such that the panel covers the opening. The panel is saturated with water before being positioned on the plate.

1 Claim, 2 Drawing Sheets

WET SMOKE MASK

BACKGROUND OF THE INVENTION

1. Field of the Invention

The present invention relates to face mask devices and more particularly pertains to a new wet smoke mask for preventing the inhalation of smoke.

2. Description of the Prior Art

The use of face mask devices is known in the prior art. U.S. Pat. No. 5,452,712 describes a hood for positioning over a user's head. Another type of face mask device is U.S. Pat. No. 5,392,465 using a chemical substance for preventing smoke inhalation.

While these devices fulfill their respective, particular objectives and requirements, the need remains for a device that is simply to use during times of high stress and is not reliant on filters or chemicals which have a shelf life.

SUMMARY OF THE INVENTION

The present invention meets the needs presented above by utilizing a pair of masks. The second mask is positionable on the first mask and including a cloth material which may be saturated with water such that the smoke permeability of the cloth is lessened.

To this end, the present invention generally comprises a first mask including a plate. The plate has size and shape for covering the face of user. The plate has an opening therein. The opening is positionable over the nose and mouth of a user. The plate has a pair of eye windows therein for seeing through the plate. A plurality of straps is attached to the first mask for removably securing the first plate to the head of a user of the device. A second mask includes an air permeable panel. The panel has a size adapted for covering the opening. A band is attached to opposite edges of the panel. The band comprises an elastic material. The second mask is positioned around the first mask such that the panel covers the opening. The panel is saturated with water before being positioned on the plate. The plate is preferably constructed of a plastic or a canvas material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
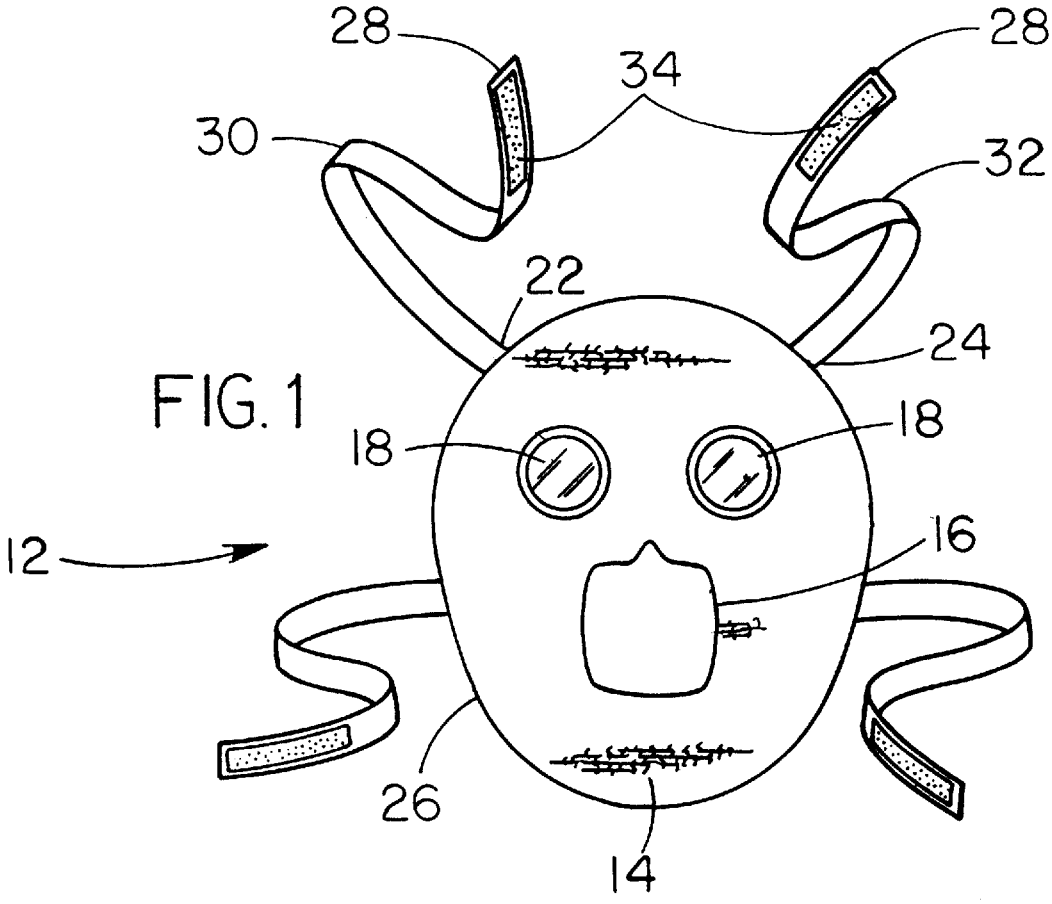
FIG. 1 is a schematic front view of a new wet smoke mask according to the present invention.
Figure 2:
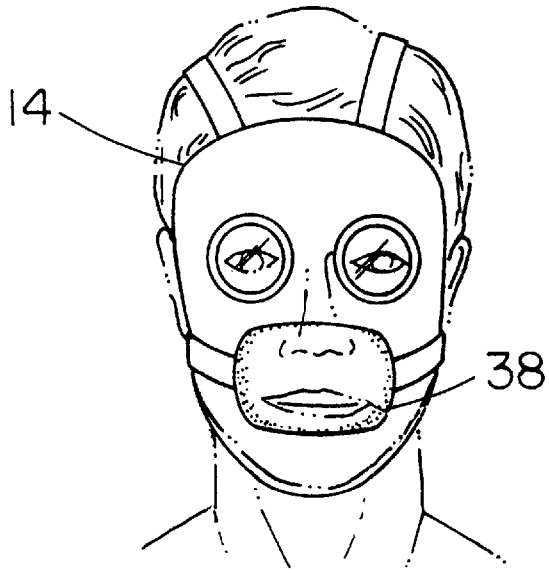
FIG. 2 is a schematic front view of the present invention.
Figure 3:
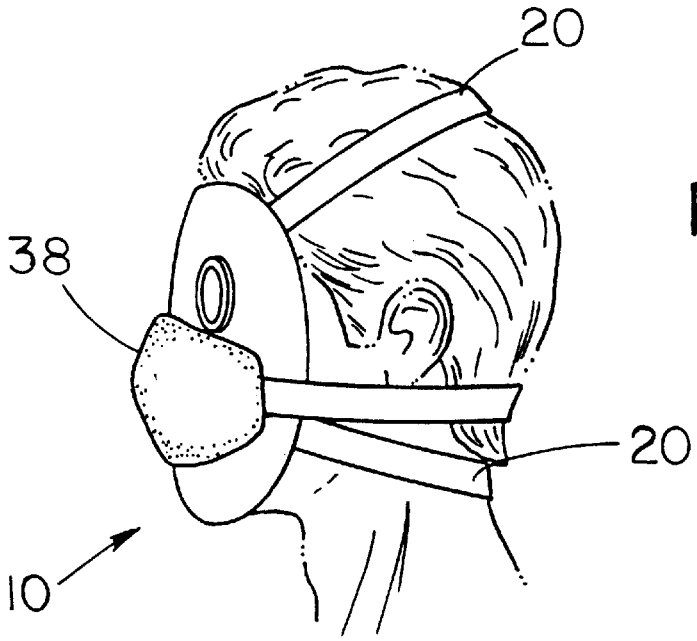
FIG. 3 is a schematic side view of the present invention.
Figure 4:
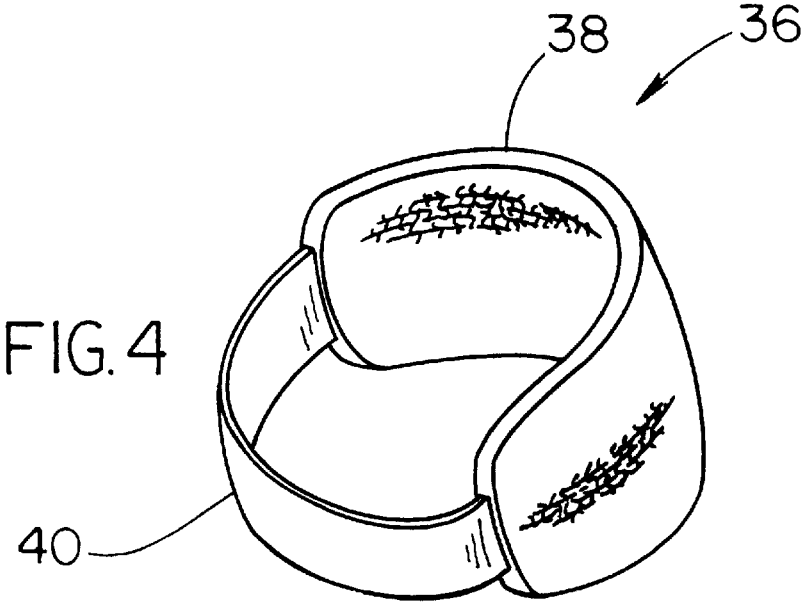
FIG. 4 is a schematic perspective view of the second mask of the present invention.

With reference now to the drawings, and in particular to FIGS. 1 through 4 thereof, a new wet smoke mask embodying the principles and concepts of the present invention and generally designated by the reference numeral 10 will be described.

As best illustrated in FIGS. 1 through 4, the wet smoke mask 10 generally comprises a first mask 12 including a plate 14. The plate 14 has size and shape for covering the face of user. The plate 14 comprises a resiliently flexible material. The plate 14 has an opening 16 therein. The opening 16 is positionable over the nose and mouth of a user. The plate 14 has a pair of eye windows 18 therein for seeing through the plate 14.

Each of a plurality of straps 20 has a first end 22 and a second end 24. Each of the first 22 and second 24 ends is attached to a peripheral edge 26 of the plate 14. The first ends 22 are positioned generally opposite of associated second ends 24 such that the straps 20 transverse an inner surface of the plate 14. Each of the straps 20 comprise an elastic material. Each of the straps 20 has a break 28 therein such that each straps 20 includes a first portion 30 and a second portion 32. A fastening means 34 releasably fastens each of the first portions 30 to an associated second portion 32.

A second mask 36 includes a panel 38. The panel 38 has a size adapted for covering the opening 16. The panel 38 comprises a cloth material, preferably a cotton material. A band 40 is attached to opposite edges of the panel 38. The band 40 comprises an elastic material.

In use, during a fire or other times of high amounts of smoke, the first mask 12 is positioned on the head of a user and the second mask 36 is positioned around the first mask 12 such that the panel 38 covers the opening 16. The panel 38 is saturated with water before it is positioned on the plate 14. The panel 38 helps to remove smoke from air taken in through the panel 38 while the eye windows 18 ensure that smoke does not hinder viewing by the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A face mask device for preventing smoke inhalation, said device comprising:

a first mask including a plate, said plate having size and shape for covering the face of user, said plate comprising a resiliently flexible material, said plate having an opening therein, said opening being positionable over the nose and mouth of a user, said plate having a pair of eye windows therein for seeing through said plate;

a plurality of straps each having a first end and a second end, each of said first and second ends being attached to a peripheral edge of said plate, said first ends being positioned generally opposite of associated second ends such that said straps transverse an inner surface of said plate, each of said straps comprising an elastic material, each of said straps having a break therein such that each straps includes a first portion and a second portion, a fastening means releasably fastening each of said first portions to an associated second portion;

a second mask including a panel, said panel having a size adapted for covering said opening, said panel comprising a cloth material;

a band separate from said first mask and said plurality of straps, said band having opposite ends with each of opposite said ends being attached to opposite edges of said panel of said second mask such that said band and said panel are positionable as a loop about the head of the user for holding said panel in a superimposed condition over said opening of said plate of said first mask, said band comprising an elastic material; and wherein said second mask is removable from a looped position about the head of the user without removing said first mask from the head of the user, said panel being saturatable with water before being positioned on said plate.

* * * * *